US011548035B2

(12) United States Patent
Bombaugh

(10) Patent No.: US 11,548,035 B2
(45) Date of Patent: Jan. 10, 2023

(54) ITEM SORTING WITH DELIVERY POINT COMPRESSION

(71) Applicant: United States Postal Service, Washington, DC (US)

(72) Inventor: Scott R. Bombaugh, Burke, VA (US)

(73) Assignee: United States Postal Service, Washington, DC (US)

( * ) Notice: Subject to any disclaimer, the term of this patent is extended or adjusted under 35 U.S.C. 154(b) by 147 days.

(21) Appl. No.: 16/938,765

(22) Filed: Jul. 24, 2020

(65) Prior Publication Data

US 2021/0023587 A1 Jan. 28, 2021

Related U.S. Application Data

(60) Provisional application No. 62/879,024, filed on Jul. 26, 2019.

(51) Int. Cl.
*B07C 3/00* (2006.01)

(52) U.S. Cl.
CPC ..... *B07C 3/006* (2013.01); *B07C 3/008* (2013.01)

(58) Field of Classification Search
CPC ..... B07C 3/003; B07C 3/006; B07C 3/008; B07C 3/00
See application file for complete search history.

(56) References Cited

U.S. PATENT DOCUMENTS

| | | | | |
|---|---|---|---|---|
| 7,390,986 | B2 * | 6/2008 | McDonald | B07C 3/00 209/584 |
| 7,671,293 | B2 * | 3/2010 | Fry | B07C 3/00 209/584 |
| 7,820,932 | B2 * | 10/2010 | Stemmle | B07C 3/00 209/583 |
| 7,858,894 | B2 * | 12/2010 | Stemmle | B07C 3/00 209/912 |
| 8,271,127 | B2 * | 9/2012 | Cartal | B07C 3/00 700/223 |
| 8,504,192 | B2 * | 8/2013 | Faivre | B07C 3/00 700/223 |
| 9,037,287 | B1 * | 5/2015 | Grauberger | B07C 9/00 700/223 |
| 9,205,461 | B2 * | 12/2015 | Norris | B07C 3/00 |
| 9,669,430 | B2 * | 6/2017 | Tresse | B07C 3/00 |
| 10,675,660 | B1 * | 6/2020 | Fagan | B07C 1/04 |
| 10,970,667 | B2 * | 4/2021 | Dearing | G06Q 10/08355 |
| 2002/0139726 | A1 * | 10/2002 | Roth | B07C 3/02 209/584 |
| 2004/0030661 | A1 * | 2/2004 | Amato | B07C 3/00 705/406 |

(Continued)

*Primary Examiner* — Patrick H Mackey
(74) *Attorney, Agent, or Firm* — Knobbe Martens Olson & Bear LLP

(57) ABSTRACT

Systems and methods for sorting items for delivery to delivery points, using delivery point compression. Items can be sorted and sequenced for delivery by a sorting machine having a finite number of sorting destinations. For routes having more delivery points than the number of sorting destinations, delivery point compression allows sorting destination assignments that eliminate delivery points not likely to receive any items. Sorting destination assignments can be performed by a processor of the sorting machine based on expected item information and delivery point item frequency scores.

20 Claims, 8 Drawing Sheets

(56) References Cited

U.S. PATENT DOCUMENTS

| | | | |
|---|---|---|---|
| 2014/0279663 | A1 | 9/2014 | Lievens et al. |
| 2015/0371187 | A1 | 12/2015 | Irwin et al. |
| 2016/0239795 | A1 | 8/2016 | Burch, V et al. |
| 2018/0121872 | A1 | 5/2018 | Walsh |
| 2018/0240181 | A1 | 8/2018 | Lopez et al. |
| 2019/0164123 | A1 | 5/2019 | McCrery et al. |

* cited by examiner

| | | | | | | | | | |
|---|---|---|---|---|---|---|---|---|---|
| SD1 | SD2 | SD3 | SD4 | SD5 | SD6 | SD7 | SD8 | SD9 | SD10 |
| | | | | | | | | | |
| SD11 | SD12 | SD13 | SD14 | SD15 | SD16 | SD17 | SD18 | SD19 | SD20 |
| | | | | | | | | | |

FIG. 3A

| | | | | | | | | | |
|---|---|---|---|---|---|---|---|---|---|
| SD1 | SD2 | SD3 | SD4 | SD5 | SD6 | SD7 | SD8 | SD9 | SD10 |
| DP1 | DP2 | DP3 | DP4 | DP5 | DP6 | DP7 | DP8 | DP9 | DP10 |
| SD11 | SD12 | SD13 | SD14 | SD15 | SD16 | SD17 | SD18 | SD19 | SD20 |
| DP11 | DP12 | DP13 | DP14 | DP15 | DP16 | | | | |

FIG. 3B

| DP | ITEM? | SCORE | DP | ITEM? | SCORE | DP | ITEM? | SCORE |
|---|---|---|---|---|---|---|---|---|
| DP1 | Y | <1 | DP11 | Y | <1 | DP21 | Y | 8.6 |
| DP2 | Y | <1 | DP12 | Y | <1 | DP22 | Y | 4.1 |
| DP3 | Y | 2.3 | DP13 | N | 5.2 | DP23 | Y | <1 |
| DP4 | N | <1 | DP14 | Y | 4.8 | DP24 | Y | 6.9 |
| DP5 | Y | 1.4 | DP15 | N | 4.9 | DP25 | N | 8.2 |
| DP6 | N | 2.2 | DP16 | N | <1 | DP26 | N | 7.8 |
| DP7 | N | <1 | DP17 | N | <1 | DP27 | Y | 3.3 |
| DP8 | Y | 4.2 | DP18 | N | <1 | DP28 | N | <1 |
| DP9 | N | <1 | DP19 | Y | 3.6 | DP29 | Y | 2.1 |
| DP10 | N | <1 | DP20 | N | <1 | DP30 | Y | 6.6 |

FIG. 3C

| SD1 | SD2 | SD3 | SD4 | SD5 | SD6 | SD7 | SD8 | SD9 | SD10 |
|---|---|---|---|---|---|---|---|---|---|
| DP1 | DP2 | DP3 | DP5 | DP8 | DP11 | DP12 | DP13 | DP14 | DP15 |
| SD11 | SD12 | SD13 | SD14 | SD15 | SD16 | SD17 | SD18 | SD19 | SD20 |
| DP19 | DP21 | DP22 | DP23 | DP24 | DP25 | DP26 | DP27 | DP29 | DP30 |

FIG. 3D

| DP | ITEM? | SCORE | DP | ITEM? | SCORE | DP | ITEM? | SCORE |
|---|---|---|---|---|---|---|---|---|
| DP1 | Y | 1.2 | DP11 | Y | <1 | DP21 | Y | 8.6 |
| DP2 | Y | 1.1 | DP12 | Y | <1 | DP22 | Y | 4.1 |
| DP3 | Y | 2.3 | DP13 | Y | 5.2 | DP23 | Y | <1 |
| DP4 | N | <1 | DP14 | Y | 4.8 | DP24 | Y | 6.9 |
| DP5 | Y | 1.4 | DP15 | Y | 4.9 | DP25 | N | 8.2 |
| DP6 | Y | 2.2 | DP16 | Y | 2.6 | DP26 | N | 7.8 |
| DP7 | N | <1 | DP17 | N | <1 | DP27 | Y | 3.3 |
| DP8 | Y | 4.2 | DP18 | N | <1 | DP28 | N | <1 |
| DP9 | N | <1 | DP19 | Y | 3.6 | DP29 | Y | 2.1 |
| DP10 | N | <1 | DP20 | Y | 1.6 | DP30 | Y | 6.6 |

FIG. 3E

| | | | | | | | | | |
|---|---|---|---|---|---|---|---|---|---|
| SD1 | SD2 | SD3 | SD4 | SD5 | SD6 | SD7 | SD8 | SD9 | SD10 |
| DP1 | DP2 | DP3 | DP5 | DP6 | DP8 | DP13 | DP14 | DP15 | DP16 |
| SD11 | SD12 | SD13 | SD14 | SD15 | SD16 | SD17 | SD18 | SD19 | SD20 |
| DP19 | DP20 | DP21 | DP22 | DP24 | DP25 | DP26 | DP27 | DP29 | DP30 |

FIG. 3F

ITEM SORTING WITH DELIVERY POINT COMPRESSION

CROSS-REFERENCE TO RELATED APPLICATIONS

This application claims the benefit of U.S. Provisional Application Ser. No. 62/879,024, filed Jul. 26, 2019, titled ITEM SORTING WITH DELIVERY POINT COMPRESSION, which is hereby incorporated by reference in its entirety.

FIELD

This disclosure relates to sorting of items in a distribution network. More specifically, the present disclosure relates to systems and methods for efficient allocation of sorting infrastructure.

DESCRIPTION OF THE RELATED TECHNOLOGY

Items, such as articles of mail, which can include letters, flats, parcels, and the like, are frequently received into a processing facility in bulk, and must be sorted into individual articles and sequenced into a desired order to facilitate further processes such as, for example, delivery of the item to a specified destination. Sorting and sequencing bulk stacks of items or articles can be done using sorting apparatuses. The sorting apparatuses and the items to be sorted take up space in a processing facility, which may be at a premium.

SUMMARY

In one embodiment, a system for sorting items comprises a sorter. The sorter comprises a scanner configured to scan a plurality of items and identify, for each of the plurality of items, a delivery point of a set of delivery points; a plurality of sorting destinations; and a processor in communication with the scanner, the processor configured to: receive, for the set of delivery points, expected item information including item information associated with a set of expected items; determine, based on the item information, expected delivery points corresponding to the set of expected items; and assign the plurality of sorting destinations to a subset of the set of delivery points, the subset including at least some of the expected delivery points. The sorter further comprises a sorting portion configured to receive the plurality of items from the scanner and to sort the plurality of items into the plurality of sorting destinations according to the sorting destination assigned for each delivery point of the subset.

In some embodiments, the subset of the set of delivery points further includes one or more prioritized delivery points of the set of delivery points. In some embodiments, the prioritized delivery points are selected based upon historical data associated with items delivered to the prioritized delivery points. In some embodiments, assigning the plurality of sorting destinations comprises: identifying one or more prioritized delivery points that are not among the expected delivery points; assigning a first subset of the sorting destinations to at least some of the expected delivery points; and assigning a second subset of the sorting destinations to the one or more prioritized delivery points that are not among the expected delivery points. In some embodiments, the plurality of sorting destinations comprise bins positioned to receive items from the sorting portion. In some embodiments, the sorting portion is further configured to divert at least one item of the plurality of items to a location other than the plurality of sorting destinations, if the delivery point identified for the at least one item is not included within the subset of the set of delivery points. In some embodiments, the plurality of sorting destinations are assigned to the subset of the set of delivery points in an order corresponding to a walk order for the subset. In some embodiments, the sorter is configured to perform subsequent sorting operations including sorting subsequent pluralities of items intended for delivery to the set of delivery points, and wherein the processor is further configured to reassign the plurality of sorting destinations to an updated subset of the set of delivery points for each subsequent sorting operation based at least in part on subsequent item information associated with each subsequent plurality of items. In some embodiments, the processor is in communication with a server of a distribution network, and wherein the expected item information is received from the server of the distribution network. In some embodiments, the processor is further configured to omit at least one of the expected delivery points when assigning the plurality of sorting destinations. In some embodiments, the at least one omitted expected delivery point is omitted based at least in part on one or more of an item frequency score or a number of expected items associated with the at least one omitted expected delivery point.

In another embodiment, a method for sorting items comprises receiving, for a set of delivery points, expected item information including item information associated with a set of expected items; determining, based on the item information, expected delivery points corresponding to the set of expected items; assigning a plurality of sorting destinations to a subset of the set of delivery points, the subset including at least some of the expected delivery points; receiving, at a sorting system, a plurality of items intended for delivery to the set of delivery points; scanning the plurality of items to identify, for each of the plurality of items, a delivery point of the set of delivery points; and sorting at least some of the plurality of items into the plurality of sorting destinations according to the sorting destination assigned for each delivery point of the subset.

In some embodiments, the subset of the set of delivery points further includes one or more prioritized delivery points of the set of delivery points that are not expected delivery points. In some embodiments, the prioritized delivery points are selected based at least in part on historical data associated with items delivered to the prioritized delivery points. In some embodiments, assigning the plurality of sorting destinations comprises: assigning a first subset of the sorting destinations to at least some of the expected delivery points; and assigning a second subset of the sorting destinations to the one or more prioritized delivery points of the set of delivery points. In some embodiments, assigning the second subset of the sorting destinations comprises: identifying a second subset of the delivery points of the set of delivery points that are not expected delivery points for the set of expected items; determining delivery frequency scores associated with each of the delivery points of the second subset; and selecting, as the prioritized delivery points, one or more delivery points of the second subset of delivery points having higher item frequency scores relative to the other delivery points of the second subset. In some embodiments, the plurality of sort destinations are assigned to the expected delivery points in an order corresponding to a walk order for the subset. In some embodiments, at least one of the expected delivery points is not assigned to a sorting destination. In some embodiments, the at least one of the expected delivery points is not assigned, based at least in part on one or more of an item frequency score or a number of expected items associated with the at least one of the expected delivery points. In some embodiments, the method further comprises determining that at least one item of the plurality of items is intended for delivery to a delivery point of the set of delivery points that is not included in the subset; and diverting the at least one item to a location other than the plurality of sorting destinations.

BRIEF DESCRIPTION OF THE DRAWINGS

The foregoing and other features of the disclosure will become more fully apparent from the following description and appended claims, taken in conjunction with the accompanying drawings.

FIGS. 3A-3F schematically illustrate example assignments of sorting destinations to delivery points.

DETAILED DESCRIPTION

Figure 1:
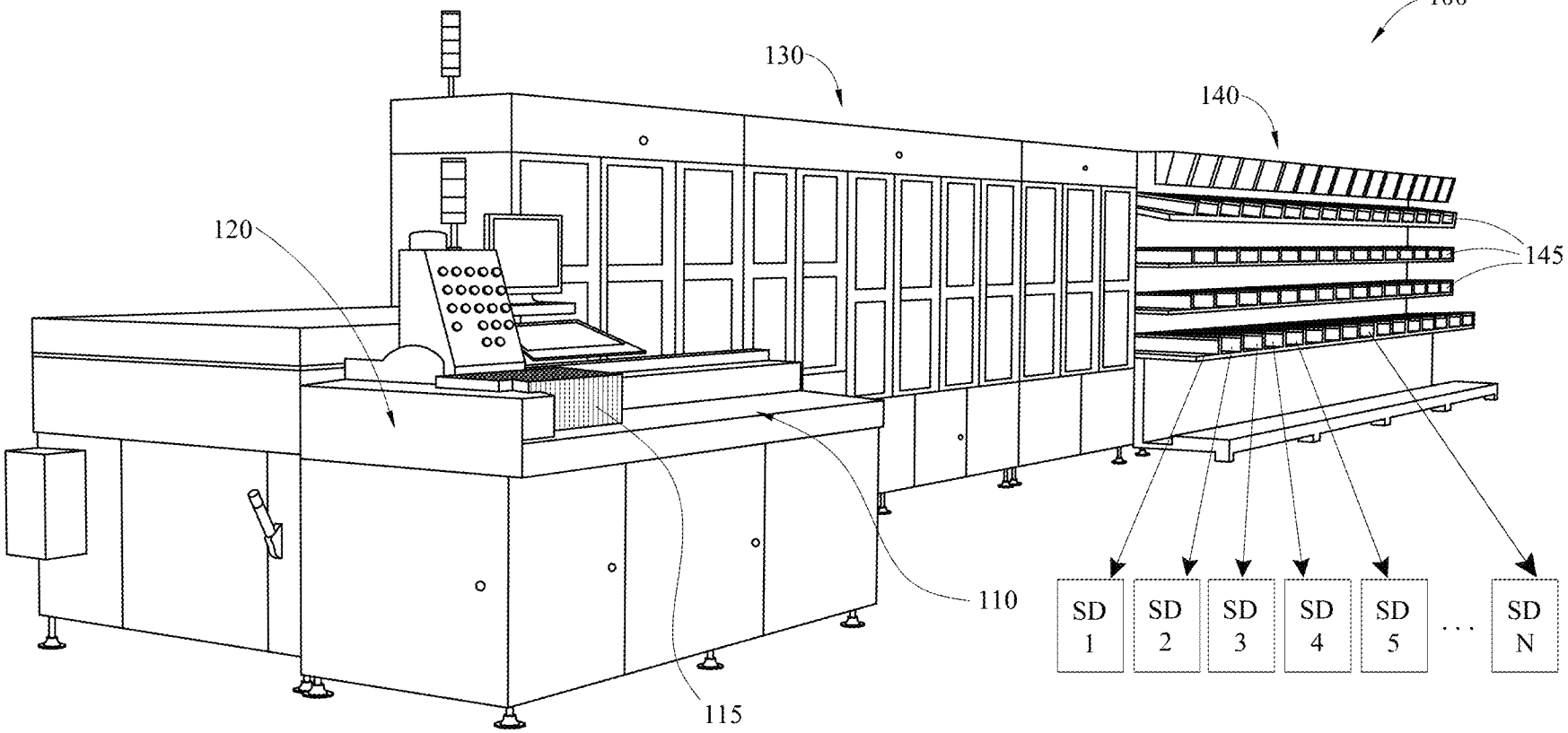
FIG. 1 is a perspective view of an example embodiment of sorting/sequencing equipment.

In the following detailed description, reference is made to the accompanying drawings. In the drawings, similar symbols typically identify similar components, unless context dictates otherwise. Thus, in some embodiments, part numbers may be used for similar components in multiple figures, or part numbers may vary from figure to figure. The illustrative embodiments described herein are not meant to be limiting. Other embodiments may be utilized, and other changes may be made, without departing from the spirit or scope of the subject matter presented. It will be readily understood that the aspects of the present disclosure and illustrated in the figures, can be arranged, substituted, combined, and designed in a wide variety of different configurations by a person of ordinary skill in the art, all of which are made part of this disclosure.

The system described herein provides for faster and more efficient sorting and sequencing of bulk articles, such as, for example, articles of mail. The articles of mail for sorting may include items of various size and shape, such as letters, flats, and parcels. Articles of mail such as magazines and catalogs, which are too long in one direction to be considered a standard sized letter, are often called flats. Flats may be received in a processing facility in bulk, separate from letters or other articles of mail. The flats and letters are processed to sort and sequence the flats and letters into a desired sequence, such as in a delivery sequence order. The delivery sequence order can be the order of delivery points to which a carrier navigates along his or her delivery route, such as the order in which the carrier visits addresses along the carrier's delivery route. By using a combination of new machines and sorting methods, the footprint of items and machines can be reduced, machine run time can be optimized, and delivery resources can be used efficiently.

Item processing equipment may process and/or sort set of received items into a set of sorting destinations. Item processing equipment can be interchangeably described as sorting equipment or apparatus, processing equipment or apparatus, sorters, machines, mail processing equipment (MPE), and the like, without departing from the scope of the current disclosure. Each individual set of received items may correspond to a defined set of delivery points such as an individual item carrier's daily delivery route, a ZIP code, or the like. In one example, a set of items to be sorted includes all flats and packages intended for delivery to delivery points along a particular item carrier's route on a particular date (e.g., the day of or after the items are received at the sorting location). The sorting destinations may include a plurality of bins, stackers, shelves, or other receptacles within, near or which are part of a sorter or other item processing equipment. For each sorting operation, individual sorting destinations may each be assigned to a particular delivery point or a group of delivery points (e.g., several delivery points located in close proximity or adjacent in a delivery walk order). In existing facilities, each sorting destination, or bin, stacker, or the like, has been assigned to a static delivery point. This limits the ability of the sorting or processing equipment to service all or some of the delivery points to which items need to be sorted, requiring, for example, multiple runs or passes on a sorting or processing equipment. This can also reduce the efficiency of a sorter or processing equipment. For example, when one or more destinations do not have an items intended for delivery, the storage destinations are empty in the processing equipment, and are not being utilized.

To illustrate, in many cases, the number of delivery points along a particular route or serviced by item processing equipment may exceed the number of sort destinations into which the item processing equipment can sort items. However, some of the delivery points along the route may not receive any items on a particular day. This can be particularly true in the case of a flats sorting apparatus. Many destinations do not receive any flats in a given day. Flats can be larger items than letter mail, and can include magazines, catalogs, and the like. However, the embodiments described herein relate to any item sorting process, not just those for sorting flats. In existing sort methods with static assignment of sorting destinations to delivery points, several sorting operations or passes on a single piece of item processing equipment may be required to sort a single set of items. For example, the sort destinations of the sorter may be assigned to a first subset of the possible delivery points for a first sort. Some of the items may be diverted if they are not intended for delivery to the first subset of delivery points. The sort destinations may then be reassigned to the remaining delivery points of the route, and the diverted items can be sorted in a second pass. This method is relatively inefficient, as many of the sorting destinations may not receive any items during the sorting operations and the sorting destinations in the equipment may be empty, or may contain no items for delivery (e.g., the sorting destinations assigned to delivery points to which none of the items is addressed).

To enhance efficiency, the present disclosure provides sorting methods including delivery point compression to improve or optimize the use of sorting equipment. In example delivery point compression implementations described herein, the sorting destinations of a sorter are dynamically assigned to delivery points for each run, during sorting runs, etc., for a facility or route or group of routes associated with the sort operation. In some embodiments, some delivery points can be omitted from the sorting destination assignment scheme for a given day. In some embodiments, the sorting destinations may be assigned based on tracking data indicating which delivery points along a particular route will be receiving items on a particular day. Additionally, because the tracking data may contain some inaccuracies, some of the sorting destinations may be assigned to delivery points for which no items are expected, but which receive items frequently. Thus, in some embodiments, the sorting systems and methods may advantageously enhance the efficiency of sorting equipment runtime by eliminating unneeded or unused delivery points from sorting destination mappings while minimizing the frequency of receiving items that do not have corresponding sorting destinations.

Although the present disclosure describes systems and devices for sorting articles of mail, such as letters, packages, or flats, it will be apparent to one of skill in the art that the disclosure presented herein is not limited thereto. For example, the development described herein may have application in a variety of manufacturing, assembly, distribution, or sorting applications.

A distribution network as described herein may comprise multiple levels. For example, a distribution network may comprise processing facilities such as regional distribution facilities, hubs, and unit delivery facilities, and other desired levels. For example, a nationwide distribution network may comprise one or more regional distribution facilities having a defined coverage area (such as a geographic area), designated to receive items from intake facilities within the defined coverage area, or from other regional distribution facilities. The regional distribution facility can sort items for delivery to another regional distribution facility, or to a hub level facility within the regional distributional facility's coverage area. A regional distribution facility can have one or more hub level facilities within its defined coverage area. A hub level facility can be affiliated with a few or with many unit delivery facilities, and can sort and deliver items to the unit delivery facilities with which it is associated. In the case of the United States Postal Service, the unit delivery facility may be associated with a ZIP code. The unit delivery facility receives items from local senders, and from hub level facilities or regional distribution facilities. The unit delivery facility also sorts and stages the items intended for delivery to destinations within the unit delivery facility's coverage area. The unit delivery facility may be associated with one or more delivery routes. In various embodiments, the sorting systems and methods described herein may be located at regional distribution facilities, hub level facilities, unit delivery facilities, or other facilities of a distribution network.

In a distribution network, items for delivery are brought into a processing facility. As used herein in, processing facility may refer to a regional distribution facility, a hub, or a unit delivery facility. In the processing facility, items are processed in preparation for the next stage in the delivery scheme. Incoming items into a processing facility may not be sorted or sequenced, and may be randomly ordered. Therefore, sorting and sequencing may be required at the processing facility to sort and sequence items according to the next stage in the delivery scheme. Where the processing facility is a unit delivery facility, for example, the items must be sorted and sequenced into delivery routes and into delivery sequence order.

Items can be sorted according to item type, delivery point, class of service, or any other criteria. Items which are intended for delivery within a defined geographic area near the processing facility, or intended for delivery to a particular destination or plurality of destinations, can be sorted by separating these items from items with other, different delivery end points. Items intended for delivery to a destination outside of the defined geographic area, particular destination or plurality of destinations can be processed and/or sent to another processing facility nearer their delivery end points. The sorting systems and methods described herein may be implemented in conjunction with (e.g., before or after) other sorting operations. For example, a group of items received at a unit delivery facility for delivery may first be sorted into individual sets of items, each set corresponding to a defined geographic area such as one or more delivery routes to be traveled by item carriers. Each set may subsequently be sorted and sequenced, such as by the delivery point compression sorting methods disclosed herein, at the same or different sorting equipment at the processing facility.

Where items are intended for delivery within a defined geographic area or to a specific plurality of destinations, such as at a unit delivery facility, the items can be sequenced into a specific order, such as into delivery sequence order. A delivery sequence order can correlate to a particular delivery route which is serviced by a particular delivery resource, such as a carrier or vehicle. In this case, the delivery sequence order corresponds to the order in which delivery end points, such as addresses, are encountered as the delivery resource or carrier follows the particular delivery route. Where the items are mail pieces, the delivery sequence order corresponds to the addresses encountered as the mail carrier walks and/or drives his route. For example, the first house a carrier encounters on his delivery route may be assigned a delivery end point value of "1". The second house the carrier encounters on his delivery route may be assigned a delivery end point value of "2", and so on throughout the delivery route. In some embodiments, the delivery end point values may start at any number, and may increment by 1 as each subsequent delivery end point is encountered. Other values, such as alphanumeric codes and the like can be used for the delivery end point values.

A processing facility can use automated processing equipment to sort items. Where the distribution network is the United States Postal Service (USPS), every day a processing facility receives a very high volume of items, such as letters and flats, which must be sorted and sequenced for delivery. Sorting and sequencing is accomplished using automated sorting equipment which can scan, read, or otherwise interpret a delivery point from each item processed. The delivery point may be encoded in a computer readable code, such as a bar code printed on or affixed to the item. In some embodiments, the delivery point may be read by taking an image of the item and performing an optical character recognition (OCR) process on the image, and determining the delivery point from the OCR'd address. In some embodiments, the automated sorting equipment can apply a computer readable code that encodes the delivery point to the item. In some embodiments, the processing facility uses sorting/sequencing apparatuses which can process 30,000 items per hour. A typical USPS processing facility may also serve 200 or more delivery routes, each with multiple delivery points.

An example of sorting/sequencing equipment that may be used in some embodiments is depicted in FIG. 1. Sorter/sequencer 100 includes an intake system 110. The intake system 110 may be a counter or other receiving structure where a stack of items 115, such as flats, or another grouping of items, are brought to be fed into the sorter/sequencer 100.

The intake system 110 may provide a surface or surfaces on which to place the stack of items 115 to stage the items for processing. The sorter/sequencer 100 system has a scanning portion 120 that includes a scanner (not shown) which scans or reads a computer readable code or performs OCR of an image of part or all of an item 115 in order to identify various characteristics of the item(s) 115, such as class of service, addressee, and/or delivery end point. The sorter/sequencer 100 includes a processor configured to control the operation of the sorter/sequence 100, including controlling the movement of items through the sorter/sequencer 100 via conveyor belts, pinch belts, and/or motors, controlling the scanning portion 120 to facilitate the intake, sorting, and sequencing the items 115. The processor is a memory in communication with the processor where information from the scanner is stored for further use. The memory can be part of the sorter/sequencer 100, or may be remote to the sorter/sequencer 100. The memory may be on a network with which the processor can communicate, and the memory may be shared by different components within a processing facility. The memory is configured to store the identity of each article processed, including information scanned, read, or interpreted from the letter, such as delivery end point, sender, class of service, postage, serial number, and the like. The memory is also configured to store the sequence of items in the item stream as they are scanned.

The sorter/sequencer 100 further includes a sorting portion 130. The sorting portion 130 may be a large storage and conveyor cabinet as shown, which has inside various components (not shown), for directing items 115 along particular pathways as the items 115 are sorted. The sorting portion 130 may be located adjacent to or otherwise near the intake system 120. In some embodiments, the items 115 may be moved or transported from the intake system 120 to the sorting portion 130 by an automated system including series of pinch belts, vacuum belts, or other conveying mechanisms. As the items are moved or transported from the intake system 120 to the sorting portion 130, the items are read or scanned, and destinations identified for each individual item 115. The processor then operates a system of motors, conveyors, and pinch belts to direct the item to the stacker portion 140.

The stacker portion 140 may be a structural system having a plurality of sorting destinations 145 arrayed, in some embodiments, in vertically disposed rows. Each sorting destination 145 is configured to receive one or more items 115 from the sorting portion 130. Each sorting destination 145 can be assigned to a particular delivery point or to a plurality of delivery points, such as a group of delivery points located near an individual stop along a route serviced by a delivery vehicle. In some embodiments, the sorting destinations 145 may be bins or other containers, and may be removable from the sorter/sequencer 100.

If the number of delivery points is large, the number of sorting destinations 145 in the stacker portion 140 must also be large to contain the large number of sorting destinations 145, or the items for a particular route must be sorted in multiple passes through the sorter/sequencer 100. Some aspects of the present application describes systems and methods which reduce or compress the number of delivery points assigned to the sorting destinations 145 of a sorter/sequencer 100, and thereby enhance or optimize runtime efficiency of the sorter/sequencer 100, improve facility space utilization, and other advantages. FIG. 1 depicts a plurality of individual sorting destinations 145 (SD1, SD2, . . . SD N). Some or all of the individual sorting destinations 145 (SD1, SD2, . . . SD N) can be assigned to one or more delivery points in accordance with a sorting destination assignment scheme. During the course of a day, week, month, etc., each individual sorting destinations 145 may be reassigned repeatedly, for example, as a plurality of different sorting destination assignment schemes are used consecutively for sorting different sets of items.

The items from each sorting destination 145 may be put into one or more trays using an automatic sweeper (not shown), which pushes items from each sorting destination 145 into an adjacent tray. The trays used may be similar to those described in U.S. Pat. No. 10,202,248, entitled TRANSFORMABLE TRAY AND TRAY SYSTEM FOR RECEIVING, TRANSPORTING AND UNLOADING ITEMS, the entire contents of which are hereby incorporated by reference.

Figure 2:
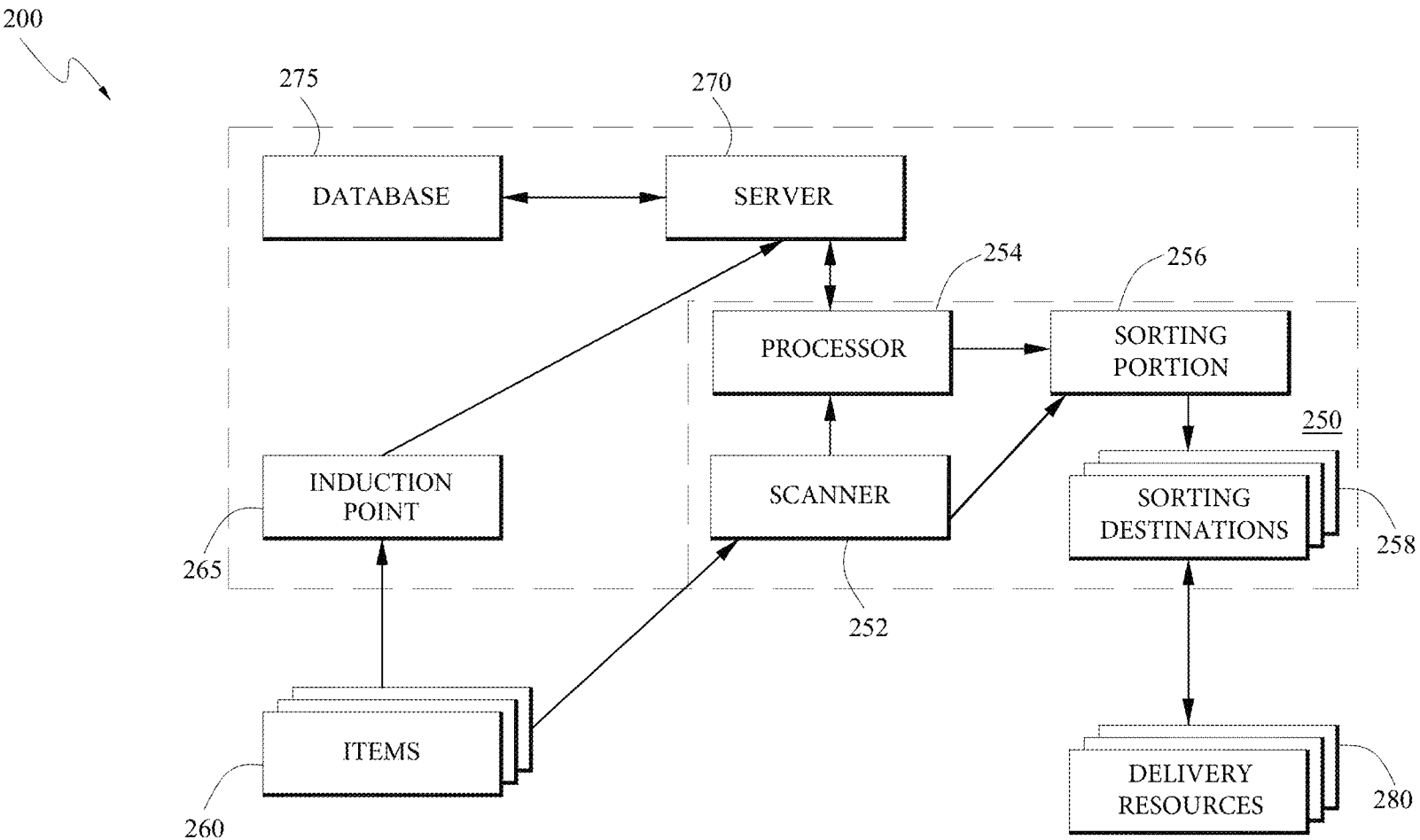
FIG. 2 is a block diagram of an embodiment of a sorting system implemented in a distribution network.

FIG. 2 is a block diagram of an embodiment of a sorting system 200 including a sorter 250 implemented in a distribution network 201. The distribution network 201 distributes items 260 to recipients via delivery resources 280 such as vehicles, item carriers, and the like. The distribution network includes an induction point 265 which obtains identification information from the items 260 when they are inducted into the distribution network 201, and a sorter 250 which sorts the items 260 based on the identification information when the items 260 reach destination of the distribution network 201, such as a hub, regional facility, or unit delivery facility where the items 260 are sorted and sequenced to be delivered by delivery resources 280. A server 270 is in communication with the induction point 265, the sorter 250, and a database 275.

The induction point 265 includes one or more devices configured to obtain information from items 260, which can be a package, envelope, parcel, flat, or the like. For example, the induction point 265 can include processing equipment having elements such as an optical scanner, a drop box, a computer configured to generate postage information and/or item labels, or other components. The sorter 250 similarly includes a scanner 252 configured to obtain information from items 260. The scanner 252 may include an optical scanner, a barcode scanner, or the like. The sorter 250 further includes a processor 254, a sorting portion 256, and a plurality of sorting destinations 258. The processor 254 can interact with and/or control operation of the scanner 252 and the sorting portion 256. The processor 254 is further configured to communicate with the server 270.

The server 270 includes one or more computing devices including a processor and onboard memory configured to execute automated receptacle management processes. The memory can store data received from the processor and send data stored thereon to the processor. In various embodiments, the server 270 can be a single computing device, or can include multiple computing devices in the same or different locations. Multiple computing devices of the server 270 can be in communication via a wired connection and/or a wireless connection such as the internet or other communication network. Some or all of the computing devices of server 270 can be located, for example, at a facility of the distribution network 201 containing an induction point 265, at a unit delivery facility of the distribution network 201 containing a sorter 250, or elsewhere, such as in a centralized distribution network control location.

At the induction point 265, items 260 are inducted into the distribution network 201 and transferred directly or indirectly to the sorter 250. Information received from the items 260 at the induction point 265, such as item identification information (e.g., an alphanumeric identification or tracking number such as an item identifier), postage payment information, destination information (including an identifier of a delivery point where the item is intended to be delivered), recipient information, or other information, can be sent to the server 270. The sorter 250 (e.g., at scanner 252) detects at least one type of information from items 260 that was also detected at the induction point 265, such as item identification information, so that items 260 arriving at the sorter 250 can be matched to items 260 received at the induction point 265. The sorter 250 is further configured to receive information from the server 270, such as delivery resource route information (e.g., lists of delivery points located along individual routes, walk orders, stop groups, delivery point frequency scores, etc.), expected item information (e.g., a list of items expected to be received for delivery within a period such as a morning, afternoon, day, week, etc., or a list of delivery points to which items are expected to be delivered on a particular day), rules for sorting destination assignment, and the like.

The server 270 is configured to receive information from the induction point 265 and send and receive information to and from the sorter 250. The server 270 is further configured to send information to and receive information from the database 275. For example, the server 270 can cause entries within the database 275 to be created, modified, and/or deleted. In some embodiments a central computing device of the server 270 can control functions such as overall management of the sorter 250 and profiles or other information associated with delivery points, delivery resources 280, etc., and a remote computing device of the server 270 located at the office containing the sorter 250 can control destination-specific functions such as allocation/assignment of sorting destinations 258 to delivery points or items 260 based on expected item information, delivery point frequency scores, etc.

In an illustrative example workflow, a plurality of items 260 are received at induction points 265 throughout the distribution network 201 and transported, by the distribution network 201, to facilities in the distribution network. The distribution network 201 may track the items 260 as they are transported between facilities of the distribution network 201, and may calculate, for each item, an expected date of arrival at a facility along its route (e.g., the unit delivery facility where a particular sorter 250 is located). Accordingly, the server 270 may send to the distribution network facility (e.g., to the processor 254 of the sorter 250 at a unit delivery facility, or at any other level of the distribution network) expected item information including one or more lists of incoming items 260 that are expected to arrive at the distribution network facility on a particular day. The expected item information may be sent periodically, such as daily (e.g., the server 270 may send expected item information each evening corresponding to the items expected to be received for sorting the following day).

A number of delivery routes to be serviced by delivery resources 280 may originate at a unit delivery facility. Thus, the incoming items 260 identified in the expected item information may be divided into a plurality of sets of items 260, with each set of items 260 corresponding to the set of delivery points located along an individual delivery route to be traveled by a delivery resource 280. When items 260 are received at a facility for sorting, they may be divided into groups according to the individual delivery routes, and each group of items 260 may be sorted in an individual sorting operation using the sorter 250. When a group of items 260 is sorted at the sorter 250, each item 260 is received at the scanner 252, which scans the item 260 to obtain item information and passes the item to the sorting portion 256. The processor 254 receives the item information, identifies a delivery point corresponding to each item 260, and causes the sorting portion 256 to direct each item 260 to one of the sorting destinations 258 that corresponds to the item's delivery point. Sorting operations will be described in greater detail below.

FIGS. 3A-3F schematically illustrate example processes of assigning sorting destinations to delivery points, using delivery point compression, in sorting equipment such as the sorter/sequencer 100 of FIG. 1 or the sorter 250 of FIG. 2. For purposes of illustration, the example implementations of FIGS. 3A-3F are shown with reference to simplified sorting equipment including 20 sorting destinations. However, it will be understood that the delivery point compression implementations described herein may equally be applied to sorting equipment having any number of sorting destinations, such as 10, 20, 30, 40, 50, or more sorting destinations controlled by one or more sorters.

FIG. 3A schematically illustrates a set of sorting destinations SD1-SD20 of an example sorter. Each sorting destination can be assigned to an individual delivery point or group of delivery points for each sorting operation. In some embodiments, the sorting destinations are assigned to delivery points in a walk order corresponding to an order of the delivery points along an item carrier's route. A sorter or component thereof (e.g., sorting portion 130 or sorting portion 256) under control of a processor (e.g., processor 254) can direct each item scanned at the sorter to any of the sorting destinations SD1-SD20. In some embodiments, the sorter may further be configured to direct items to an additional destination other than sorting destinations SD1-SD20. For example, an item may be directed to an alternative sorting destination if the item is intended for a delivery point that is not assigned to any of the sorting destinations SD1-SD20, if an error occurs when scanning the item, or if the item is otherwise unable to be properly sorted to one of the sorting destinations SD1-SD20.

FIG. 3B illustrates an example assignment of sorting destinations to delivery points for a simple example case in which the total number of delivery points along a route is less than the number of available sorting destinations. In the example of FIG. 3B, a sorting operation will be performed for a route having 16 delivery points or delivery point groups, represented in a walk order as delivery points DP1-DP16. Because the example sorter has 20 sorting destinations, there are enough sorting destinations to assign a sorting destination to each of the 16 delivery points DP1-DP16 along the route. However, routes frequently have a number of delivery points or delivery point groups greater than the number of sorting destinations available.

FIGS. 3C and 3D illustrate an example implementation of delivery point compression in a sorting operation for a route including a number of delivery points greater than the number of available sorting destinations. As shown in FIG. 3C, the set of delivery points corresponding to an exemplary route that includes 30 delivery points D1-D30. Thus, an individual sorting destination cannot be assigned to each of the 30 delivery points without requiring multiple sorting passes and/or reducing the efficiency of equipment runtime. The item processing equipment has 20 sorting destinations, leaving 10 delivery points which cannot be assigned to a sorting destination in a single sorting pass, run, or operation. However, delivery point compression as described herein may be utilized to sort all items for the route without requiring multiple sorting passes.

In one example method of sorting with delivery point compression, expected item information and item frequency scores may be used to selectively and dynamically assign sorting destinations to delivery points. The delivery point tables in FIG. 3C indicate, for each of the 30 delivery points D1-D30 of the exemplary route, whether any items are expected for delivery to the delivery point and an item frequency score associated with the delivery point. For example delivery point DP5 is expected to receive at least one item, and has an item frequency score of 1.4. Delivery point DP 26 is not expected to receive any items, and has an item frequency score of 7.8. In the illustrated embodiment, the item frequency score for each delivery point is the average number of items received each day at the delivery point. A lower item score means that a delivery point is less likely to receive an item than a delivery point with a higher score.

The "ITEM?" column in the delivery point tables indicates, for a group of items to be sorted in a particular sort operation or according to a facility or machine sort plan, whether any of the items in the group is addressed to each delivery point. The sorter may determine whether one or more items are expected for an individual endpoint based on expected item information received from the server 270 or otherwise received from the distribution network. This information can be based on known incoming inventory of items for a facility. In some embodiments, the expected item information may include a predetermined daily list of delivery points to which items are addressed. In other embodiments, the expected item information may include a list of item identifiers and their associated delivery points, and the delivery point-specific determination may be made at the sorter or another local computing resource. In various embodiments, this information regarding incoming items and/or the associated delivery points may be based at least in part on tracking data obtained throughout the distribution network.

Item frequency scores, as shown in the "SCORE" column, may be calculated based on historic data regarding items delivered to the delivery points along the route. As illustrated, the item frequency score for each delivery point is the average number of items received each day at the delivery point. It will be understood that other types of item frequency scores may be used, for example, based on average time between receiving items, historical accuracy of expected item information for the delivery point, etc., without departing from the scope of this disclosure. In the example depicted in FIG. 3C, the item frequency scores may be the average number of items received daily at each delivery point, averaged over a time period such as one or more weeks, one or more months, one or more years, etc. In some embodiments, the item frequency scores may be maintained locally (e.g., at the sorter and/or at one or more other computing resources at the unit delivery facility where the sorter is located) and/or may be maintained remotely (e.g., at the database 275) and sent to the sorter periodically (e.g., daily) combined with or separately from the expected item information.

In the example of FIG. 3C, expected item information has been received for a daily sort operation for the route containing delivery points DP1-DP30. For this sort operation, the expected item information indicates that the group of items to be delivered along the route on a particular day includes at least one item intended for delivery to each of delivery points DP1, DP2, DP3, DP5, DP8, DP11, DP12, DP14, DP19, DP21, DP22, DP23, DP24, DP27, DP29, and DP30. The expected item information may or may not additionally indicate how many items are expected to be delivered to each delivery point. Because the expected item information indicates that items are expected for only 16 of the 30 delivery points on the route, all 16 delivery points to which an item is to be delivered are assigned to individual sorting destinations, leaving four unused sorting destinations.

However, the expected item information may not necessarily be 100% accurate. For example, the expected item information may indicate that a delivery point is expected to receive an item, while the expected item has in fact been delayed and will not arrive at the unit delivery facility until a subsequent day. In another example, an item may unexpectedly arrive at the unit delivery facility one or more days prior to its expected arrival date, such as on a day when no items are expected to be received for the corresponding delivery point. In addition, some items may be inducted at the distribution network facility having the sorter, and there is no manifest information for these items. The server 270 will not know that these items are part of the batch for sorting. In some embodiments, some items are not addressed to individual delivery points, but are assigned to all points on a route, or in a geographic area. These items may also not be on a manifest of expected items in the sort plan. Such inaccuracies may occur with relative frequency, even in distribution networks having a confidence level of 90% or more for item tracking. In some embodiments, the excess sorting destinations may be assigned based on frequency scores to mitigate the risk of item sorting errors due to inaccuracies in the expected item information.

In the example of FIGS. 3C-3D, the four remaining sorting destinations may be assigned to four of the delivery points for which no items are expected. In some embodiments, these additional delivery points are selected by identifying, of the delivery points for which no items are expected, the delivery points whose frequency scores indicate that they are most likely to receive an unexpected item. In the present example, delivery points DP13, DP15, DP25, and DP26 have the highest frequency scores of all delivery points having an "N" in the "ITEM?" column. Accordingly, as shown in the sorting destination assignment chart of FIG. 3D, delivery points DP13, DP15, DP25, and DP26 are included in the sorting destination assignments despite being expected not to receive any items in this sort operation. Thus, the 20 available sorting destinations are dynamically assigned to a subset of the delivery points along the route in a process that improves or optimizes the probability that all items will be sorted successfully in the sort operation. The number of items that cannot be sorted, and that are redirected for automatic or manual re-sorting, is reduced.

FIGS. 3E and 3F illustrate an example implementation similar to that of FIGS. 3C and 3D, in which the expected item information indicates that items will be received at more delivery points or delivery point groups than the number of sorting destinations in the sorter. In the example of FIGS. 3E and 3F, 21 of the delivery points DP1-DP30 are expected to receive items for this sort operation. In some embodiments, one or more delivery points or delivery point groups may be removed from the sorting destination assignments despite being expected to receive one or more items, based on item frequency scores. For example, delivery points DP11, DP12, and DP23 are each expected to receive one or more items, but have item frequency scores indicating that they each receive an average of less than one item per day. Thus, it may be determined that removing these delivery points or delivery point groups from the sorting destination assignment is least likely to cause sorting errors. In some embodiments, the removal of delivery points or delivery point groups may be based on additional information such as the number of items expected to be received. For example, if the expected item information further indicated that three items were expected for delivery point DP12 in this sort operation, and only one item was expected for each of delivery points DP11 and DP23, the sorter could retain delivery point DP12 in the sorting destination assignments while removing delivery points DP11 and DP23.

As shown in FIG. 3F, the final sorting destination assignment plan includes 18 of the 21 delivery points for which items are expected, and two of the delivery points (DP25 and DP26) for which no items are expected. A variety of methods may be used to determine when delivery points with no expected items should be included instead of, rather than only in addition to, the delivery points for which items are expected. In some embodiments, the sorter may be configured to assign a fixed number of the sorting destinations to the delivery points for which items are expected (e.g. "expected" delivery points) and to assign a fixed number of the sorting destinations to some of the delivery points for which items are not expected (e.g., "prioritized" delivery points). In some embodiments, the sorter may be configured to assign a variable number of the sorting destinations based on a thresholding and/or comparison approach. For example, the sorter may automatically selected as "prioritized," and assign sorting destinations to, any delivery points that are not "expected" delivery points but have an item frequency score above a predetermined threshold. Where necessary, one or more of the "expected" delivery points may be omitted from the sorting destination assignment plane to make room for the "prioritized" delivery points based on having an item frequency score below a predetermined low threshold and/or based on having a low number of expected items (e.g., only one or two items). In one particular example, if a number N of low-frequency delivery points need to be removed from the sorting destination assignment plan to accommodate the "prioritized" delivery points, the sorter may first identify the set of delivery points expected to receive only one item, and then select for removal the N lowest item frequency scores from among the set.

In some embodiments, the delivery points can be removed or added to the sorting destination assignments based on the class of service of the expected item. For example, if the item intended for delivery to DP11 is of a particular class of service, such as first class mail, overnight mail, 2-day mail, or another class, then DP11 will not be removed from the sorting assignments, and the delivery point having the next lowest score, DP2 at 1.1, will be removed from the sorting destination assignments. This determination can be made for each delivery point as well. If the item for delivery to DP2 is a next day air mail item, then DP2 will be given a sorting destination assignment, and DP1, with a score of 1.2 will be excluded from the sorting destinations. This analysis can occur for each of the delivery points as they are evaluated for inclusion in the sorting destination assignments. In some embodiments, the identity of the recipient can be used to determine how to assign the delivery points to the sorting destinations. For example, a business customer or a customer which has signed up and requested delivery priority may be given higher priority in any sort plan. In some embodiments, where the destination is a business and is known to be closed, or to have limited operation hours, for example, if the delivery day is Saturday, the business delivery point may be excluded from the sort plan, even if there is an item for delivery to the business.

In some embodiments, the delivery point assignments described above can be done for a specific type of item or subset of items being processed in the distribution network. For example, the delivery points can be assigned for sort plans for flats, residual mail, letter mail, parcels, etc. In one example, the expected item status can indicate whether a flat is expected for delivery to a delivery point, regardless of whether there is another type of item for delivery point. The "SCORE" can indicate a score for the type of items, and not for all items. For example, the "SCORE" can be a value based on the frequency of delivery of flats, or another subset of items.

Figure 4:
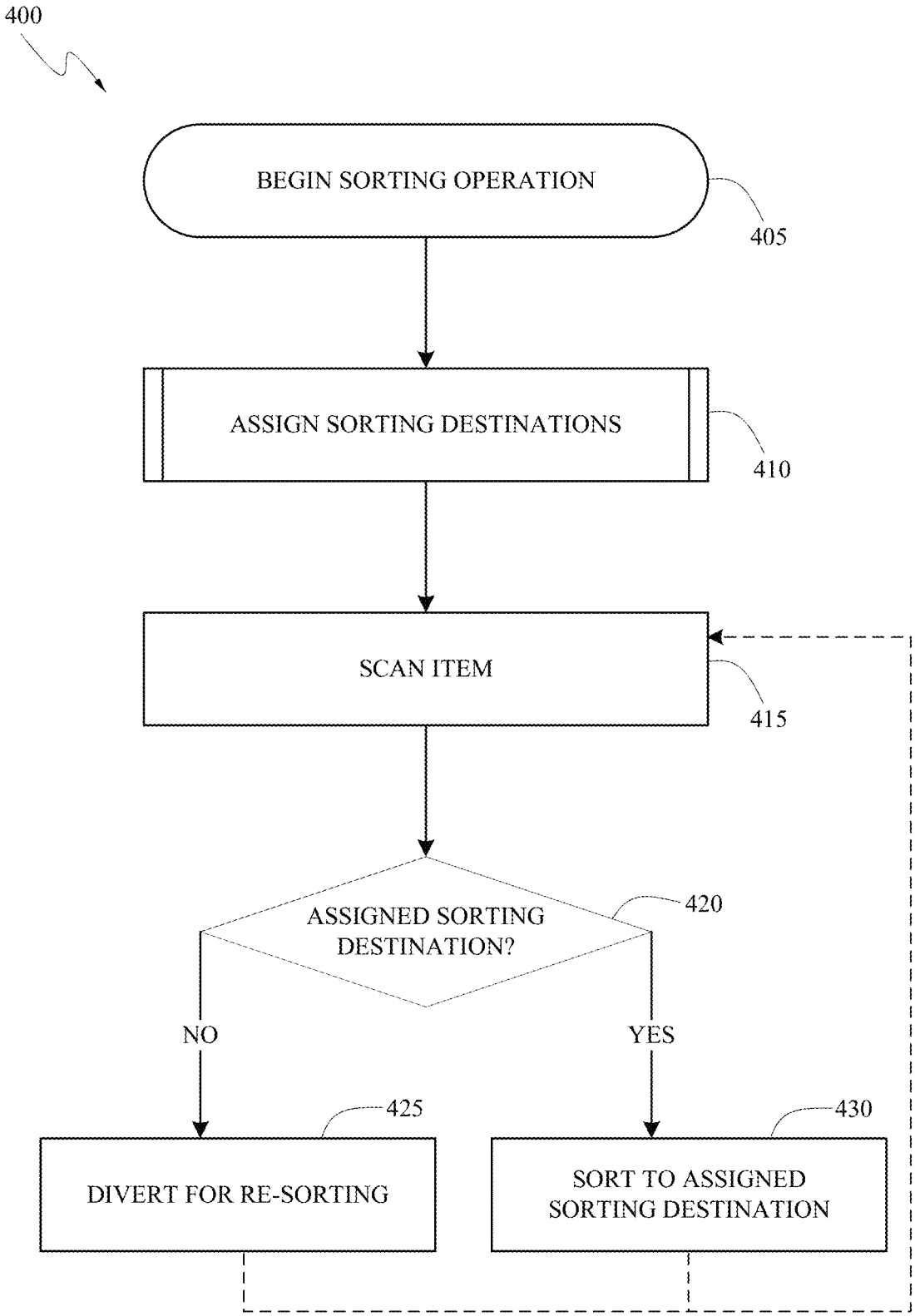
FIG. 4 is a flowchart illustrating an exemplary method of sorting a plurality of items using delivery point compression.

FIG. 4 is a flowchart illustrating an exemplary method 400 of sorting a plurality of items using delivery point compression. The method 400 can be implemented to sort and/or sequence a group of items using a sorter such as the sorter/sequencer 100 or the sorter 250 described herein, to prepare the items for delivery along a route traveled by a delivery resource 280 such as an item carrier or a delivery vehicle. The method 400 can be performed by a computer system integrated within a system such as the distribution network 200, the sorter/sequencer 100, and/or the sorter 250. For example, the method 400 can be performed at least in part by components such as the server 270, the database 275, the processor 254, the scanner 252, and the sorting portion 256. It will be appreciated that some or all steps of the method 400 can be performed locally and/or remotely. For example, in some embodiments the entire method 400 can be performed by a sorter 250 based on information and computer executable instructions stored within a memory of the sorter 250, or the method 400 can be performed by the sorter 250 at least partly based on information and/or computer executable instructions stored within a remote memory such as the database 275.

The method 400 begins at block 405 when a sorting operation is initiated. The sorting operation can be initiated periodically or based on an event. In some embodiments, the method 400 can be performed weekly, daily, or multiple times per day at a facility of a distribution network, for example, at the beginning or end of each day that the facility is open. Alternatively or in addition, the method 400 can be performed based on an event such as the arrival of a group of items to be distributed, availability of an employee to sort items for delivery resource routes, or another initiating event. A sorting operation may be performed individually for individual groups of items, each group of items being intended for delivery along a particular delivery resource route, such as a walk route or a vehicle delivery route. When the sorting operation has been initiated, the method 400 continues to sub-process 410.

At sub-process 410, the sorting destinations 258 of the sorter 250 are assigned. The sub-process 410 of assigning sorting destinations 258 to delivery points is described in greater detail below with reference to FIG. 5. At the completion of sub-process 410, some or all of the sorting destinations 258 of the sorter 250 are assigned to individual delivery points or delivery point groups, such that the sorter 250 is ready to begin sorting the items of the group of items. When the sorting destinations have been assigned, the method 400 continues to block 415. Assigning the sorting destination provides instructions to the sorting equipment on how to move items through the equipment in response to the delivery point read from the item. These instructions can be used to operate diverter gates, diverter wedges, to turn on or turn off various pick and transport belts, activate/deactivate vacuum sources, and/or otherwise control mechanical operation of the sorting equipment to move the items to their assigned sorting destinations.

At block 415, an item is scanned. The item may be scanned at the scanner 252 of the sorter 250. When the item is scanned, the scanner 252 receives item information from a label on the item, such as by reading a machine readable barcode or QR code, using OCR to read textual information printed on the label, etc. The item information read from the label may include the delivery point to which the item is intended to be delivered. In other embodiments, the item information read from the label may include an item identifier which the sorter 250 may use to determine the corresponding delivery point such as by querying a memory of the sorter and/or the database 275 of the distribution network. In some embodiments (e.g., for flats), the item may be received from a stack of items to be scanned. In some embodiments, the item may be individually provided to the scanner by an employee or other use of the sorter. When the item has been scanned and the corresponding delivery point determined, the method 400 continues to decision state 420.

At decision state 420, the processor 254 determines whether the item's delivery point has a sorting destination assigned to it in the current sorting destination assignment plan assigned in block 410 In some embodiments, the determination at decision state 420 may be made by querying a data structure such as the sorting destination assignment plans of FIGS. 3C-3F, which may be stored locally in a memory of the sorter 250 or remotely. If the processor 254 determines that a sorting destination is not assigned to the delivery point corresponding to the item, the method continues to block 425. At block 425, the sorting portion 256 diverts the item to an additional destination where the item can be sent for automatic or manual re-sorting, can be placed manually into an appropriate location within the sorted and sequenced items, or can be stored to be sorted with the next sorting operation performed for the same route (e.g., the next day). The method 400 then returns to block 415, where the next item is scanned.

If the processor 254 determines at decision state 420 that a sorting destination is assigned to the delivery point corresponding to the item, the method continues to block 430. At block 430, the sorting portion 256 directs the item to the assigned sorting destination within the item sorting corresponding to the item's intended delivery point. The sorting portion 256 may cause the item to be placed into a bin or other container at the sorting destination. After the item is directed to the assigned sorting destination, the method 400 returns to block 415, where the next item is scanned. Blocks 415 through 425 or 430 repeat until all items in the group of items have been scanned and sorted or diverted, thus completing the sorting operation. The entire method 400 may then be repeated for a subsequent sorting operation corresponding to a different group of items to be delivered on a different route.

Figure 5:
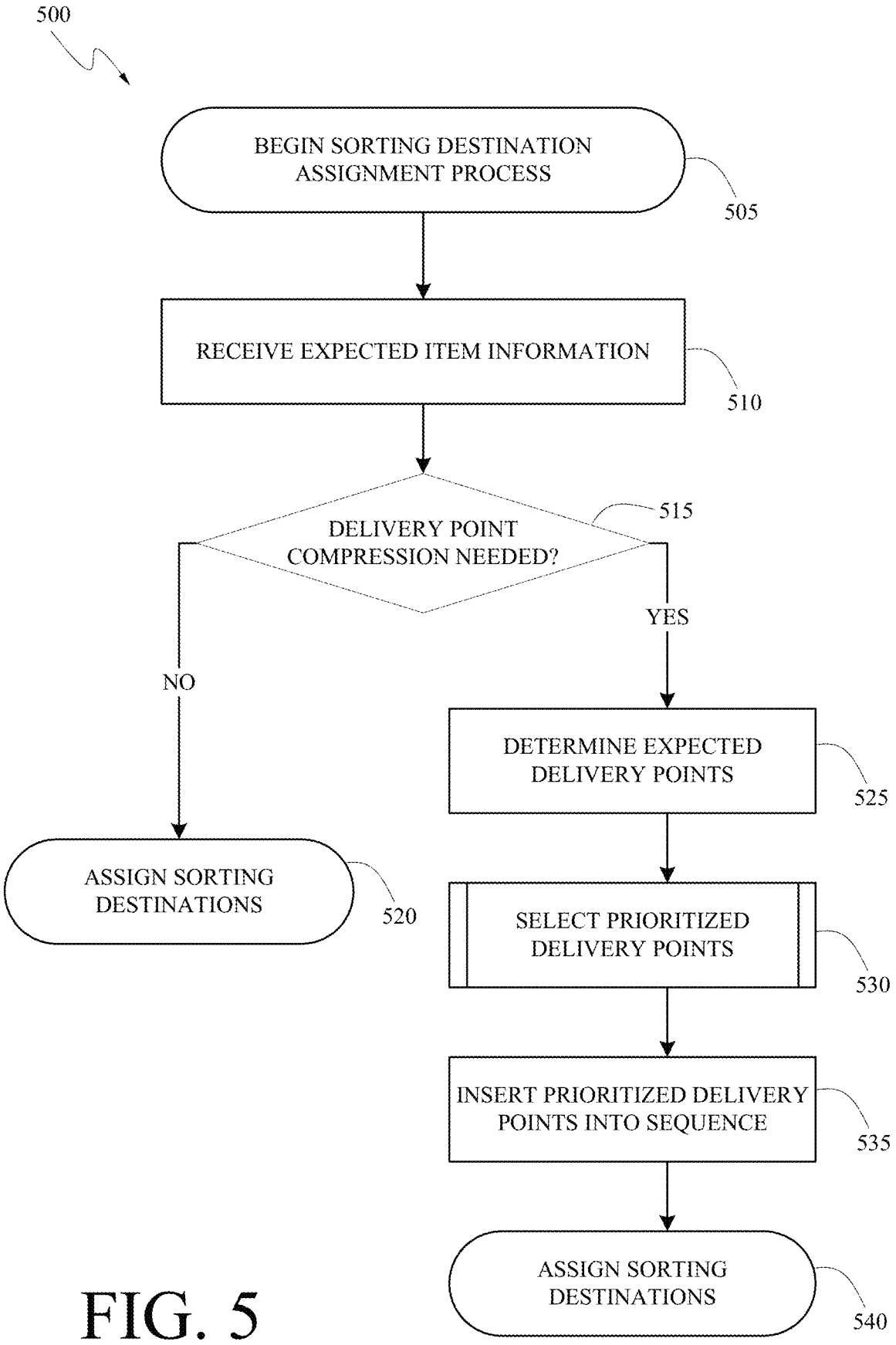
FIG. 5 is a flowchart illustrating an exemplary method of assigning sorting destinations to items in a sorting system using delivery point compression.

FIG. 5 is a flowchart illustrating an exemplary method 500 of assigning sorting destinations to items in a sorting system using delivery point compression. The method 500 is one example method of performing the sub-process 410 of FIG. 4, and can be implemented to dynamically assign a plurality of sorting destinations such as the sorting destinations 145 or 258 of a sorter such as the sorter/sequencer 100 or the sorter 250 described herein. The method 500 is used for dynamic assignment of sorting destinations, as it may be performed prior to sorting items each time a sorting operation is performed, such that each sorting operation with delivery point compression is performed with a customized sorting destination assignment plan that enhances or optimizes runtime efficiency of the sorting equipment. The method 500 can be performed by a computer system integrated within a system such as the distribution network 200, the sorter/sequencer 100, and/or the sorter 250. For example, the method 500 can be performed at least in part by components such as the server 270, the database 275, and the processor 254. It will be appreciated that some or all steps of the method 500 can be performed locally and/or remotely. For example, in some embodiments the entire method 500 can be performed by a sorter 250 based on information and computer executable instructions stored within a memory of the sorter 250, or the method 500 can be performed by the sorter 250 at least partly based on information and/or computer executable instructions stored within a remote memory such as the database 275.

The method 500 begins at block 505 when a sorting destination assignment process is initiated. The sorting destination assignment process may be initiated at the processor 254 of the sorter 250, for example, when the method 400 of FIG. 4 arrives at sub-process 410 in the context of performing a sorting operation for a group of items and a delivery resource route. When the sorting destination assignment process is initiated, the method 500 continues to block 510.

At block 510, expected item information is received for the group of items to be sorted. For example, the processor 254 may send an expected item information request to the server 270 of the distribution network, including an identifier of the route or set of delivery points, and a date or time for the sorting operation. The server 270 may send the expected item information to the processor 254. In various embodiments, the expected item information may include one or more of a list of the "expected" delivery points, a number of items expected at each of the "expected" delivery points, individual or aggregated item information corresponding to the expected items, delivery point item frequency scores, and/or other information associated with the expected items and/or the delivery points of the route. After the expected item information is received, the method 500 continues to decision state 515.

At decision state 515, the processor 254 determines whether delivery point compression is needed for a sort plan. In some embodiments, the processor 254 can compare the total number of delivery points along the route to the number of sorting destinations 258 available at the sorter 250. If the number of available sorting destinations 258 is greater than or equal to the number of delivery points, the processor 254 determines that delivery point compression is not needed, and the method terminates at block 520 as a sorting destination 258 is assigned to each of the delivery points in the route. If the number of available sorting destinations 258 is less than the number of total delivery points, the processor 254 determines that delivery point compression is needed, and the method continues to block 525. Other circumstances can give rise to a decision to compress the delivery points, for example, if the facility plan has limited sorter operation time available, if insufficient operators are available to operate the sorting equipment, if a service class is in jeopardy, if the sort is occurring on a weekend and it is desired to minimize resource use or maximize resource efficiency, or other scenarios.

At block 525, the processor 254 determines which of the delivery points are "expected" delivery points (e.g., those for which one or more items are expected to be in the group of items in the sorting operation). In some embodiments, the set of "expected" delivery points may be received from the server 270 with the expected item information. In other embodiments, the set of "expected" delivery points is determined at the processor 254 or another computing device local to the sorter 250, based on aggregating the individual delivery points associated with the items identified in the expected item information. After the "expected" delivery points are determined, the method 500 continues to sub-process 530.

At sub-process 530, the processor 254 may select one or more "prioritized" delivery points. As described above, the processor 254 may first determine which delivery points of the route are not among the set of "expected" delivery points. The processor 254 may compare the item frequency scores of those delivery points to a threshold or may otherwise identify delivery points that are not "expected" delivery points but that should nevertheless be included in the sorting destination assignment plan as "prioritized" delivery points. After the "prioritized" delivery points are selected, the method 500 continues to block 535.

At block 535, the "prioritized" delivery points are inserted into the delivery point sequence according to a route order. For example, the "prioritized" delivery points may be combined with the "expected" delivery points in an appropriate sequence such that the final set of assigned delivery points are maintained in the correct order corresponding to the walk order or other delivery order for the route. In some embodiments, as described above with reference to FIGS. 3E and 3F, the process of inserting the "prioritized" delivery points into the delivery point sequence may also include removing one or more of the "expected" delivery points from the sequence as necessary, for example, to comply with a maximum number of available sorting destinations 258. Thus, the result of the insertion at block 535 is a route-sequenced list of a subset of delivery points, including a total number of delivery points less than or equal to the number of available sorting destinations 258 of the sorter 250. After the "prioritized" sorting destinations are inserted, the method 500 continues to block 540.

At block 540, the method 500 terminates as the sorting destinations 258 of the sorter 250 are assigned. Assignment of the sorting destinations may include storing, in a memory of the sorter 250, a table or other relational data structure in which each of the sorting destinations 258 is listed in association with the delivery point or delivery point group assigned to the sorting destination 258. The memory may be in communication directly or indirectly with the sorting portion 256 such that, when the items are subsequently scanned at the scanner 252 of the sorter 250 and received at the sorting portion 256, the sorting portion 256 can refer to the data structure in the memory and sort each item based on its delivery point according to the sorting destination assignments stored therein.

Figure 6:
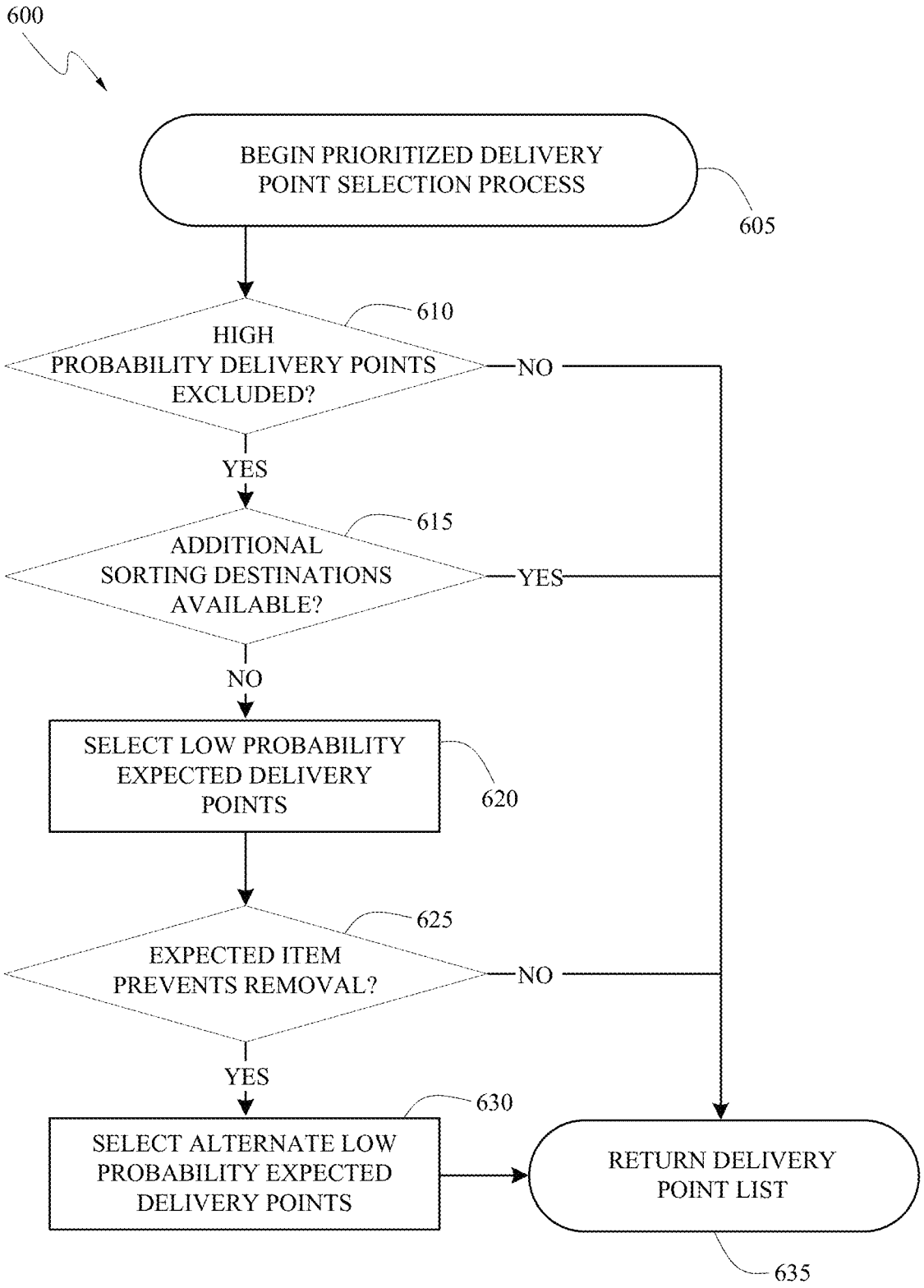
FIG. 6 is a flowchart illustrating an exemplary method of selecting prioritized delivery points within an example sorting destination assignment process.

FIG. 6 is a flowchart illustrating an exemplary method 600 of selecting prioritized delivery points within example sorting destination assignment processes of the present disclosure. The method 600 is one example method of performing the sub-process 530 of FIG. 5, and can be implemented to select a particular subset of delivery points other than expected delivery points to include in a sorting destination assignment plan, and/or to select a particular subset of expected delivery points to exclude from the sorting destination assignment plan. The method 600 may be performed in conjunction with the method 500 prior to sorting items each time a sorting operation is performed, such that each sorting operation with delivery point compression is performed with a customized sorting destination assignment plan that enhances or optimizes runtime efficiency of the sorting equipment. The method 600 can be performed by a computer system integrated within a system such as the distribution network 200, the sorter/sequencer 100, and/or the sorter 250. For example, the method 600 can be performed at least in part by components such as the server 270, the database 275, and the processor 254. It will be appreciated that some or all steps of the method 600 can be performed locally and/or remotely. For example, in some embodiments the entire method 600 can be performed by a sorter 250 based on information and computer executable instructions stored within a memory of the sorter 250, or the method 600 can be performed by the sorter 250 at least partly based on information and/or computer executable instructions stored within a remote memory such as the database 275.

The method 600 begins at block 605 when a prioritized delivery point selection process is initiated. The prioritized delivery point selection process may be initiated at the processor 254 of the sorter 250, for example, when the method 500 of FIG. 5 arrives at sub-process 530 in the context of assigning sorting destinations to delivery points for a sorting operation. When the prioritized delivery point selection process is initiated, the method 600 continues to decision state 610.

At decision state 610, the processor 254 determines whether any high probability delivery points are excluded from the set of expected delivery points. For example, the processor 254 may compare the set of expected delivery points determined at block 525 of the method 500 to the set of all delivery points associated with the sort operation to determine whether any high probability delivery points in the set of all delivery points are not among the set of expected delivery points. In some embodiments, high probability delivery points may be any delivery points having a frequency score greater than or equal to a predetermined threshold. If it is determined at decision state 610 that no high probability delivery points are excluded from the set of expected delivery points (e.g., all high probability delivery points are also expected delivery points), the method 600 terminates at block 635, where the processor 254 returns a delivery point list including the set of expected delivery points. If it is determined at decision state 610 that one or more high probability delivery points are excluded from the set of expected delivery points (e.g., at least one high probability delivery point is not among the expected delivery points), the method continues to decision state 615.

At decision state 615, the processor 254 determines whether any additional sorting destinations are available. For example, as described above with reference to FIGS. 3C-3F, the processor 254 may compare the number of expected delivery points to the number of sorting destinations available at the sorting equipment. In some embodiments, the processor 254 may compare the number of available sorting destinations to the sum of the total number of expected delivery points plus the number of high probability delivery points that are not expected delivery points. If it is determined at decision state 615 that enough sorting destinations are available to include the expected delivery points and all high probability delivery points, the method 600 terminates at block 635, where the processor 254 returns a delivery point list that includes the expected delivery points and all of the high probability delivery points that are not expected delivery points. If it is determined at decision state 615 that the sorting equipment does not include enough sorting destinations for all of the expected and high probability delivery points, the method 600 continues to block 620.

At block 620, the processor 254 selects one or more low probability delivery points from the set of expected delivery points, to be removed from the sorting destination assignment plan. In some embodiments, the processor 254 may use a predetermined low probability threshold. In other embodiments, the processor 254 may dynamically determine the expected delivery points to be removed based on the number of high probability delivery points to be added that exceed the number of available sorting destinations. For example, if the total number of expected delivery points plus the high probability delivery points to be added exceeds the total number of available sorting destinations by 5, the processor 254 may select for removal the 5 delivery points in the set of expected delivery points that have the lowest scores. After the low probability expected delivery points are selected, the method 600 continues to decision state 625.

At decision state 625, the processor 254 determines whether any of the selected low probability expected delivery points should not be removed based on one or more characteristics of the expected items associated with the low probability expected delivery points. In one example, if an expected item for one of the low probability expected delivery points is associated with a high priority class of service (e.g., next day air mail, overnight mail, etc.), the corresponding delivery point may be retained in the sorting destination assignment plan. If it is determined at decision state 625 that none of the items associated with the selected low probability expected delivery points prevent removal of those delivery points, the method 600 terminates at block 635, where the processor 254 returns a delivery point list including the remaining expected delivery points and the additional high probability delivery points. If any of the selected low probability expected delivery points are to be retained within the sorting destination assignment plan, the method 600 continues to block 630.

At block 630, the processor 254 selects one or more alternate low probability expected delivery points to remove. For example, the processor 254 may select the next lowest frequency score from among the set of expected delivery points that were not selected for removal at block 620. In some embodiments, the processor 254 can remove delivery points according to other criteria described herein, such as service class of the item for delivery, recipient ID, and the like. The method 600 then terminates at block 635, where the processor 254 returns a delivery point list that includes all expected delivery points other than those removed at blocks 620 and 630, as well as the additional high probability delivery points identified at decision state 610. The delivery point list returned at block 635 (e.g., following decision states 610, 615, or 625, or following block 630) may then be used in the method 500 as a list of delivery points to be assigned to sorting destinations at block 540.

The foregoing description details certain embodiments of the systems, devices, and methods disclosed herein. It will be appreciated, however, that no matter how detailed the foregoing appears in text, the systems, devices, and methods can be practiced in many ways. It should be noted that the use of particular terminology when describing certain features or aspects of the invention should not be taken to imply that the terminology is being re-defined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

It is noted that some examples above may be described as a process, which is depicted as a flowchart, a flow diagram, a structure diagram, or a block diagram. Although a flowchart may describe the operations as a sequential process, many of the operations can be performed in parallel, or concurrently, and the process can be repeated. In addition, the order of the operations may be rearranged. A process is terminated when its operations are completed. A process may correspond to a method, a function, a procedure, a subroutine, a subprogram, etc. When a process corresponds to a software function, its termination corresponds to a return of the function to the calling function or the main function.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A system for sorting items comprising:

a sorter comprising:

a scanner configured to scan a plurality of items and identify, for each of the plurality of items, a delivery point of a set of delivery points;

a plurality of sorting destinations;

a processor in communication with the scanner, the processor configured to:

receive, for the set of delivery points, expected item information including item information associated with a set of expected items;

determine, based on the item information, expected delivery points corresponding to the set of expected items; and assign the plurality of sorting destinations to a subset of the set of delivery points, the subset including at least some of the expected delivery points; and a sorting portion configured to receive the plurality of items from the scanner and to sort the plurality of items into the plurality of sorting destinations according to the sorting destination assigned for each delivery point of the subset.

2. The system of claim 1, wherein the subset of the set of delivery points further includes one or more prioritized delivery points of the set of delivery points.

3. The system of claim 2, wherein the prioritized delivery points are selected based upon historical data associated with items delivered to the prioritized delivery points.

4. The system of claim 2, wherein assigning the plurality of sorting destinations comprises:

identifying one or more prioritized delivery points that are not among the expected delivery points;

assigning a first subset of the sorting destinations to at least some of the expected delivery points; and assigning a second subset of the sorting destinations to the one or more prioritized delivery points that are not among the expected delivery points.

5. The system of claim 1, wherein the plurality of sorting destinations comprise bins positioned to receive items from the sorting portion.

6. The system of claim 1, wherein the sorting portion is further configured to divert at least one item of the plurality of items to a location other than the plurality of sorting destinations, if the delivery point identified for the at least one item is not included within the subset of the set of delivery points.

7. The system of claim 1, wherein the plurality of sorting destinations are assigned to the subset of the set of delivery points in an order corresponding to a walk order for the subset.

8. The system of claim 1, wherein the sorter is configured to perform subsequent sorting operations including sorting subsequent pluralities of items intended for delivery to the set of delivery points, and wherein the processor is further configured to reassign the plurality of sorting destinations to an updated subset of the set of delivery points for each subsequent sorting operation based at least in part on subsequent item information associated with each subsequent plurality of items.

9. The system of claim 1, wherein the processor is in communication with a server of a distribution network, and wherein the expected item information is received from the server of the distribution network.

10. The system of claim 1, wherein the processor is further configured to omit at least one of the expected delivery points when assigning the plurality of sorting destinations.

11. The system of claim 10, wherein the at least one omitted expected delivery point is omitted based at least in part on one or more of an item frequency score or a number of expected items associated with the at least one omitted expected delivery point.

12. A method for sorting items, the method comprising:

receiving, for a set of delivery points, expected item information including item information associated with a set of expected items;

determining, based on the item information, expected delivery points corresponding to the set of expected items;

assigning a plurality of sorting destinations to a subset of the set of delivery points, the subset including at least some of the expected delivery points;

receiving, at a sorting system, a plurality of items intended for delivery to the set of delivery points;

scanning the plurality of items to identify, for each of the plurality of items, a delivery point of the set of delivery points; and sorting at least some of the plurality of items into the plurality of sorting destinations according to the sorting destination assigned for each delivery point of the subset.

13. The method of claim 12, wherein the subset of the set of delivery points further includes one or more prioritized delivery points of the set of delivery points that are not expected delivery points.

14. The method of claim 13, wherein the prioritized delivery points are selected based at least in part on historical data associated with items delivered to the prioritized delivery points.

15. The method of claim 13, wherein assigning the plurality of sorting destinations comprises:

assigning a first subset of the sorting destinations to at least some of the expected delivery points; and assigning a second subset of the sorting destinations to the one or more prioritized delivery points of the set of delivery points.

16. The method of claim 15, wherein assigning the second subset of the sorting destinations comprises:

identifying a second subset of the delivery points of the set of delivery points that are not expected delivery points for the set of expected items;

determining delivery frequency scores associated with each of the delivery points of the second subset; and selecting, as the prioritized delivery points, one or more delivery points of the second subset of delivery points having higher item frequency scores relative to the other delivery points of the second subset.

17. The method of claim 12, wherein the plurality of sort destinations are assigned to the expected delivery points in an order corresponding to a walk order for the subset.

18. The method of claim 12, wherein at least one of the expected delivery points is not assigned to a sorting destination.

19. The method of claim 18, wherein the at least one of the expected delivery points is not assigned, based at least in part on one or more of an item frequency score or a number of expected items associated with the at least one of the expected delivery points.

20. The method of claim 12, further comprising:

determining that at least one item of the plurality of items is intended for delivery to a delivery point of the set of delivery points that is not included in the subset; and diverting the at least one item to a location other than the plurality of sorting destinations.

* * * * *